US009269306B2

(12) United States Patent
Zhang et al.

(10) Patent No.: US 9,269,306 B2
(45) Date of Patent: Feb. 23, 2016

(54) BACKLIGHT DRIVING CIRCUIT, LCD DEVICE, AND METHOD FOR DRIVING THE BACKLIGHT DRIVING CIRCUIT

(71) Applicant: SHENZHEN CHINA STAR OPTOELECTRONICS TECHNOLOGY CO., LTD, Shenzhen (CN)

(72) Inventors: Hua Zhang, Shenzhen (CN); Fei Li, Shenzhen (CN)

( * ) Notice: Subject to any disclaimer, the term of this patent is extended or adjusted under 35 U.S.C. 154(b) by 168 days.

(21) Appl. No.: 13/984,529

(22) PCT Filed: Jun. 27, 2013

(86) PCT No.: PCT/CN2013/078132

§ 371 (c)(1),
(2) Date: Aug. 8, 2013

(87) PCT Pub. No.: WO2014/153883

PCT Pub. Date: Oct. 2, 2014

(65) Prior Publication Data

US 2014/0292824 A1 Oct. 2, 2014

(30) Foreign Application Priority Data

Mar. 29, 2013 (CN) ..... 2013 1 0110132

(51) Int. Cl.
*G09G 3/34* (2006.01)
*G09G 3/36* (2006.01)

(52) U.S. Cl.
CPC ..... *G09G 3/3406* (2013.01); *G09G 3/3648* (2013.01)

(58) Field of Classification Search
CPC ..... G09G 3/3406; G09G 3/3648
See application file for complete search history.

(56) References Cited

U.S. PATENT DOCUMENTS

| | | | | |
|---|---|---|---|---|
| 2004/0056825 | A1* | 3/2004 | Min et al. | 345/38 |
| 2009/0086513 | A1 | 4/2009 | Lombardo et al. | |
| 2011/0075057 | A1* | 3/2011 | Kim et al. | 348/790 |
| 2011/0260645 | A1* | 10/2011 | Chen et al. | 315/294 |
| 2012/0074856 | A1* | 3/2012 | Takata et al. | 315/192 |
| 2012/0262961 | A1 | 10/2012 | Chien et al. | |

FOREIGN PATENT DOCUMENTS

| | | | |
|---|---|---|---|
| CN | 201733500 | U | 2/2011 |
| CN | 102185466 | A | 9/2011 |
| CN | 202178046 | U | 3/2012 |
| CN | 102711342 | A | 10/2012 |
| CN | 202759643 | U | 2/2013 |
| CN | 103151000 | A | 6/2013 |
| JP | 6-251880 | A | 9/1994 |
| KR | 1020080079775 | A | 9/2008 |

OTHER PUBLICATIONS

Fang Dingyi, the International Searching Authority written comments, Jan. 2014, CN.

* cited by examiner

*Primary Examiner* — Vijay Shankar
*Assistant Examiner* — Cory Almeida

(57) ABSTRACT

A backlight driving circuit includes a transformer, a controllable switch connected in series with a primary side of the transformer, a voltage collection unit receiving a voltage of the primary side of the transformer, and a comparing unit coupled to the voltage collection unit. When an output voltage of the voltage collection unit is less than a preset reference voltage, the comparing unit drives the controllable switch to turn on.

3 Claims, 4 Drawing Sheets

BACKLIGHT DRIVING CIRCUIT, LCD DEVICE, AND METHOD FOR DRIVING THE BACKLIGHT DRIVING CIRCUIT

TECHNICAL FIELD

The present disclosure relates to the field of a liquid crystal display (LCD), and more particularly to a backlight driving circuit, an LCD device, and a method for driving the backlight driving circuit.

BACKGROUND

A liquid crystal display (LCD) device includes and LCD panel and a backlight unit including a light emitting diode (LED) light bar and an LED backlight driving circuit. Each of LED light bars is formed by a plurality of LED lamps. When a number of the LED lamps increases, an output voltage outputted by the backlight driving circuit accordingly increases, where the output voltage is usually greater than 100V, which requires use of an isolated boost circuit, as shown in FIG. 1A and FIG. 1B. A driving signal is used to control a controllable switch Q1 to turn on/off, where the controllable switch Q1 is a metal-oxide-semiconductor field-effect transistor (MOSFET). A transformer T is used to increase the output voltage outputted by the backlight driving circuit, where a ratio of a primary coil turn and a secondary coil turn of the transformer T is 1:N. If an input voltage of the transformer T is Vin, and an output voltage of the transformer T is Vo, an equation of the output voltage of the transformer T is: $Vo=Vm*N*D/(1-D)$.

After the controllable switch Q1 turns off, a voltage of a drain electrode of the controllable switch Q1 is great, when the controllable switch Q1 turns on again, a power loss of the controllable switch Q1 is great. Additionally, temperature of the controllable switch Q1 increases, which shortens working life of components.

SUMMARY

In view of the above-described problems, the aim of the present disclosure is to provide a backlight driving circuit, a liquid crystal display (LCD) device, and a method for driving the backlight driving circuit capable of improving working life of a controllable switch.

The aim of the present disclosure is achieved by the following method.

A backlight driving circuit comprises a transformer, a controllable switch connected in series with a primary side of the transformer, a voltage collection unit receiving a voltage of the primary side of the transformer, and a comparing unit coupled to the voltage collection unit. When an output voltage of the voltage collection unit is less than a preset reference voltage, the comparing unit drives the controllable switch to turn on.

Furthermore, the voltage collection unit comprises a detection winding coupled to the primary side of the transformer, and a first resistor connected with the detection winding in parallel, number of turns of the detection winding is less than number of turns of the primary side of the transformer, the comparing unit is coupled to an end of the first resistor adjacent to the detection winding. In the present disclosure, an electromagnetic coupling method using the detection winding is used to receive the voltage of the primary side of the transformer without needing to connect to an additional load of a circuit of the primary side of the transformer, a voltage collection circuit and a main circuit can be isolated. Namely the main circuit is not affected when the voltage collection circuit is damaged, which improves reliability of the main circuit. Additionally, the present disclosure uses the detection winding to proportionally reduce a large voltage of the primary side of the transformer, and obtains a low voltage through dividing the voltage by the first resistor. The low voltage is safer than the large voltage, and withstand voltage requirement of the components to the low voltage is low, which reduces cost of the voltage collection circuit and the comparing circuit.

Furthermore, the comparing unit comprises a comparator, where a non-inverting end of the comparator receives the preset reference voltage, and an inverting end of the comparator is coupled to the voltage collection unit. When the output voltage of the voltage collection unit is less than the preset reference voltage, the comparing unit drives the controllable switch to turn on. This is a specific circuit structure of the comparing unit.

Furthermore, the comparing unit comprises a second resistor and a filter capacitor, where the inverting end of the comparator is coupled to the voltage collection unit through the second resistor. The filter capacitor is connected between the inverting end of the comparator and a ground terminal of the backlight driving circuit. A delay time exists between a lowest voltage of the primary side of the transformer and a lowest value of an oscillation waveform of the drain electrode of the controllable switch. Thus, in order to reduce the oscillation and the EMI as much as possible when a loss of the controllable switch reduces, a resistor-capacitor (RC) filter circuit is connected between the inverting end of the comparator and the voltage collection unit, and the delay time may be adjusted by adjusting the second resistor and the filter capacitor. When amplitude of a first resonance oscillation of the drain electrode of the controllable switch reaches a lowest value, a zero voltage signal detected by a third winding circuit is sent to the inverting end of the comparator, and the comparator outputs a high level to control the controllable switch to turn on again, and the voltage between the source electrode and the drain electrode of the controllable switch is low in the moment that the controllable switch turns on. Thus the loss is reduced, the voltage of the drain electrode is reduced to zero quickly and does not oscillate, thereby reducing EMI.

Furthermore, the voltage collection unit comprises a detection winding coupled to the primary side of the transformer, and a first resistor connected with the detection winding in parallel. Number of turns of the detection winding is less than number of turns of the primary side of the transformer. The comparing unit comprises a comparator, a second resistor, and a filter capacitor. A non-inverting end of the comparator receives the preset reference voltage, an inverting end of the comparator is coupled to a first end of the detection winding through the second resistor, and current of the detection winding flows out from the first end of the detection winding. The filter capacitor is connected between the inverting end of the comparator and a ground terminal of the backlight driving circuit. This is a specific backlight driving circuit. An electromagnetic coupling method using the detection winding is used to receive the voltage of the primary side of the transformer without needing to connect to an additional load of a circuit of the primary side of the transformer, a voltage collection circuit and a main circuit can be isolated. Namely the main circuit is not affected when the voltage collection circuit is damaged, which improves reliability of the main circuit. Additionally, the present disclosure uses the detection winding to proportionally reduce a large voltage of the primary side of the transformer, and obtains a low voltage through dividing the voltage by the first resistor. The low voltage is safer than the large voltage, and withstand voltage requirement of the components to the low voltage is low, which reduces costs of the voltage collection circuit and the comparing circuit. A delay time exists between a lowest voltage of the primary side of the transformer and a lowest value of an oscillation waveform of the drain electrode of the controllable switch. Thus, in order to reduce the oscillation and the EMI as much as possible when a loss of the controllable switch reduces, a resistor-capacitor (RC) filter circuit is connected between the inverting end of the comparator and the voltage collection unit, and a delay time may be adjusted by adjusting the second resistor and the filter capacitor. When amplitude of a first resonance oscillation of the drain electrode of the controllable switch reaches a lowest value, a zero voltage signal detected by a third winding circuit is sent to the inverting end of the comparator, and the comparator outputs a high level to control the controllable switch to turn on again, and the voltage between the source electrode and the drain electrode of the controllable switch is low in the moment that the controllable switch turns on. Thus the loss is reduced, the voltage of the drain electrode is reduced to zero quickly and does not oscillate, thereby reducing EMI.

Furthermore, the backlight driving circuit comprises a light emitting diode (LED) light bar, and the LED light bar is coupled to two ends of a secondary side of the transformer. This is a backlight driving circuit using the LED light bar as light source.

Furthermore, the backlight diving circuit further comprises a rectifier diode connected in series between the secondary side of the transformer and the LED light bar. A cathode of the rectifier diode is coupled to an input end of the LED light bar, and an anode of the rectifier diode is coupled to the secondary side of the transformer. The rectifier diode can control a flow direction of the current, which avoids the current from flowing to the secondary side of the transformer.

Furthermore, the backlight driving circuit further comprises an electrolytic capacitor, and the electrolytic capacitor is connected with the LED light bar in parallel. When an output current of the secondary side of the transformer is not sufficient for the LED light bar to light, the electrolytic capacitor may release stored power energy to maintain the LED light bar to light.

A method for driving a backlight driving circuit of the present disclosure, comprising steps:

A: setting the preset reference voltage;

B: receiving the output voltage of the primary side of the transformer; and

C: comparing the output voltage of the primary side of the transformer with the preset reference voltage; when the output voltage is less than the preset reference voltage, the controllable switch turns on, when the output voltage is not less than the reference voltage, the controllable switch turns off.

A liquid crystal display (LCD) device comprises the backlight driving circuit of the present disclosure.

The voltage collection unit and the comparing unit are used in the present disclosure, and the preset reference voltage is low. When the output voltage of the primary side of the transformer is less than the preset reference voltage, the controllable switch turns on, at this time, because the output voltage of the primary side of the transformer is low, and is even zero, current flowing through the side of the transformer is low, which reduces power loss of turn-on of the controllable switch and improves working life of the controllable switch.

A parasitic capacitor is generated between a source electrode and a drain electrode of the controllable switch (such as the parasitic capacitor C1 in FIG. 1A). When the controllable switch turns off, the parasitic capacitor can be continuously charged by an input voltage of the transformer, and store energy, after the energy in a primary coil of the transformer is completely released, the energy is again conveyed to the primary coil turn of the transformer by the parasitic capacitor. Thus, resonance is generated between the primary coil of the transformer and the parasitic capacitor, which causes a sinusoidal oscillation of the voltage of the drain electrode of the controllable switch, thereby influencing electromagnetic interference (EMI). However, in the present disclosure, the controllable switch turns on when the voltage is close to zero, thus the resonance is not generated between the primary coil of the transformer and the parasitic capacitor, thereby reducing the EMI.

DETAILED DESCRIPTION

Figure 2:
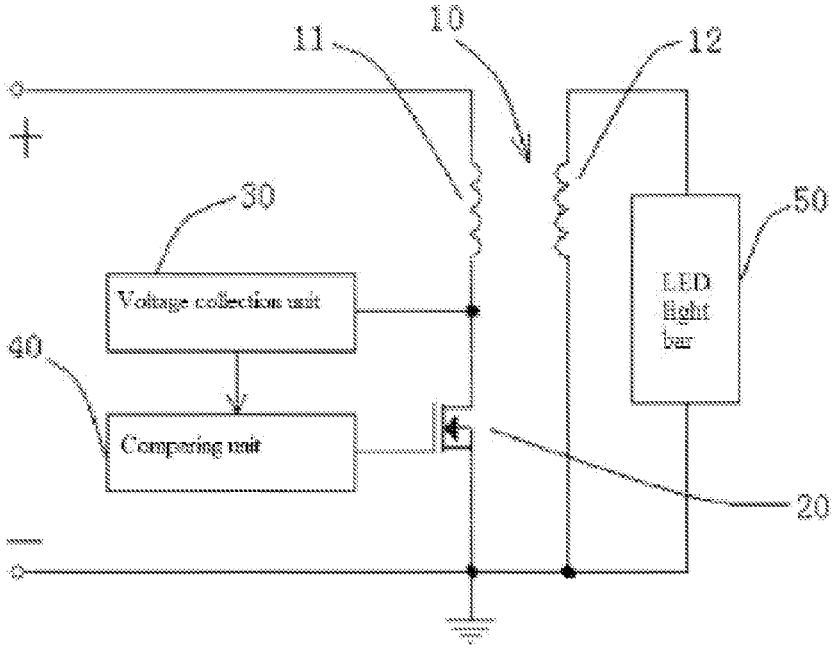
FIG. 2 is a schematic diagram of a backlight driving circuit of the present disclosure.

As shown in FIG. 2, a liquid crystal display (LCD) device comprises a backlight driving circuit. The backlight driving circuit comprises a transformer 10, a controllable switch 20 connected in series with a primary side 11 of the transformer 10, a voltage collection unit 30 receiving a voltage of the primary side 11 of the transformer 10, and a comparing unit 40 couples to the voltage collection unit 30. A secondary side 12 of the transformer 10 is coupled to a light emitting diode (LED) light bar 50.

When an output voltage of the voltage collection unit 30 is less than a preset reference voltage, the comparing unit 40 drives the controllable switch 20 to turn on. A semiconductor power component, such as a metal-oxide-semiconductor field-effect transistor (MOSFET) and the like, may be used as the controllable switch 20.

The voltage collection unit and the comparing unit are used in the present disclosure, and the preset reference voltage is low. When the output voltage of the primary side of the transformer is less than the preset reference voltage, the controllable switch turns on, at this time, because the output voltage of the primary side of the transformer is low, and is even zero, current flowing through the controllable switch is accordingly low, which reduces power loss of turn-on of the controllable switch, and improves working life of the controllable switch.

Figure 1A:
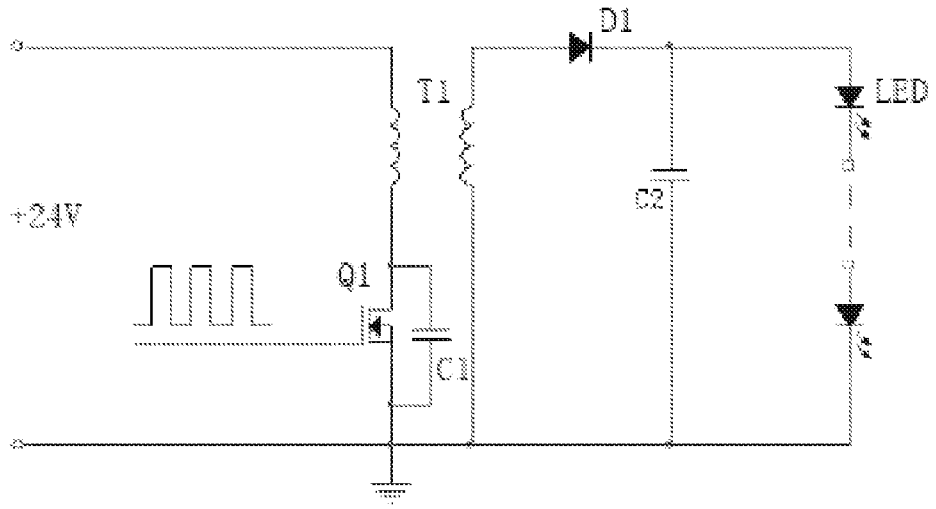
FIG. 1A PRIOR ART
FIG. 1A is a schematic diagram of a backlight driving circuit of the prior art.
Figure 1B:
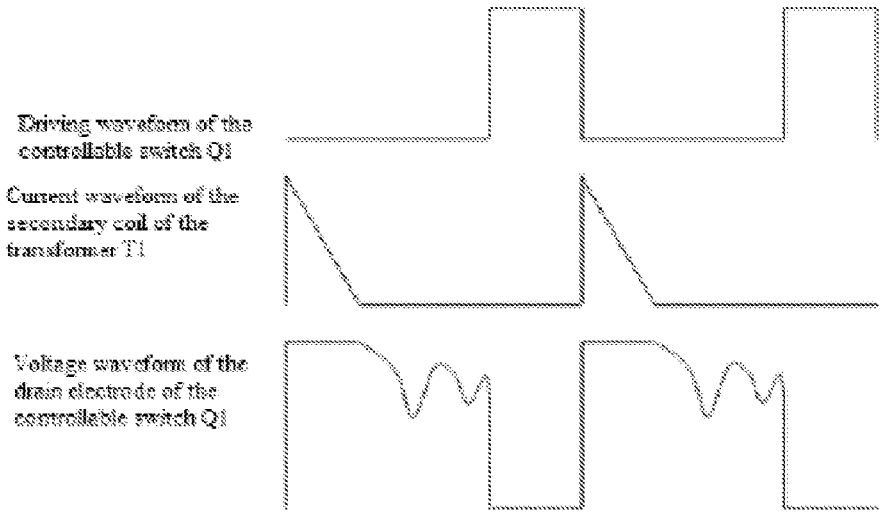
FIG. 1B PRIOR ART
FIG. 1B is a schematic diagram of a backlight driving circuit of the prior art.

A parasitic capacitor is generated between a source electrode and a drain electrode of the controllable switch (such as the parasitic capacitor C1 in FIG. 1A). When the controllable switch turns off, the parasitic capacitor can be continuously charged by an input voltage of the transformer, and store energy; after the energy in a primary coil of the transformer is completely released, the energy is again conveyed to the primary coil turn of the transformer by the parasitic capacitor. Thus, resonance is generated between the primary coil of the transformer and the parasitic capacitor C1, which causes sinusoidal oscillation of the voltage of the drain electrode of the controllable switch Q1, thereby influencing electromagnetic interference (EMI). However, in the present disclosure, the controllable switch turns on when the voltage is close to zero, thus the resonance is not generated between the primary coil of the transformer and the parasitic capacitor C1, thereby reducing EMI.

The present disclosure is further described in detail in accordance with the figures and the exemplary examples.

EXAMPLE 1

Figure 3A:
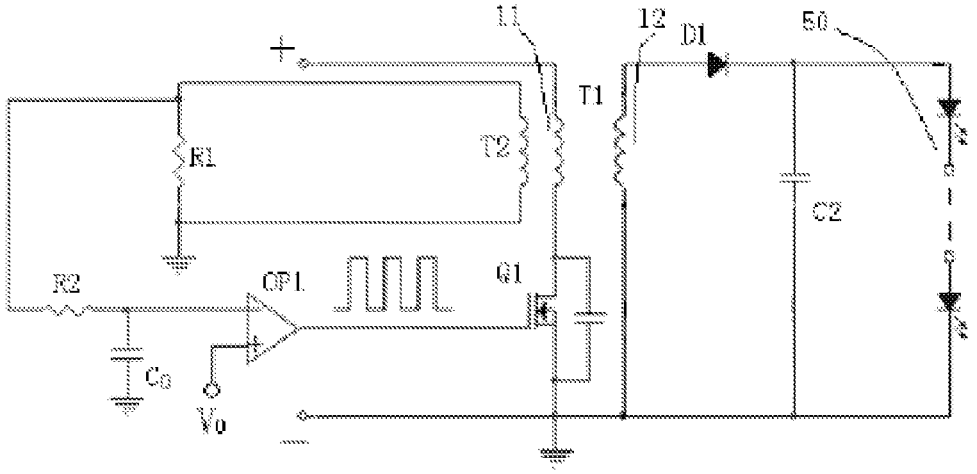
FIG. 3A is a schematic diagram of a backlight driving circuit of a first example of the present disclosure.
Figure 3B:
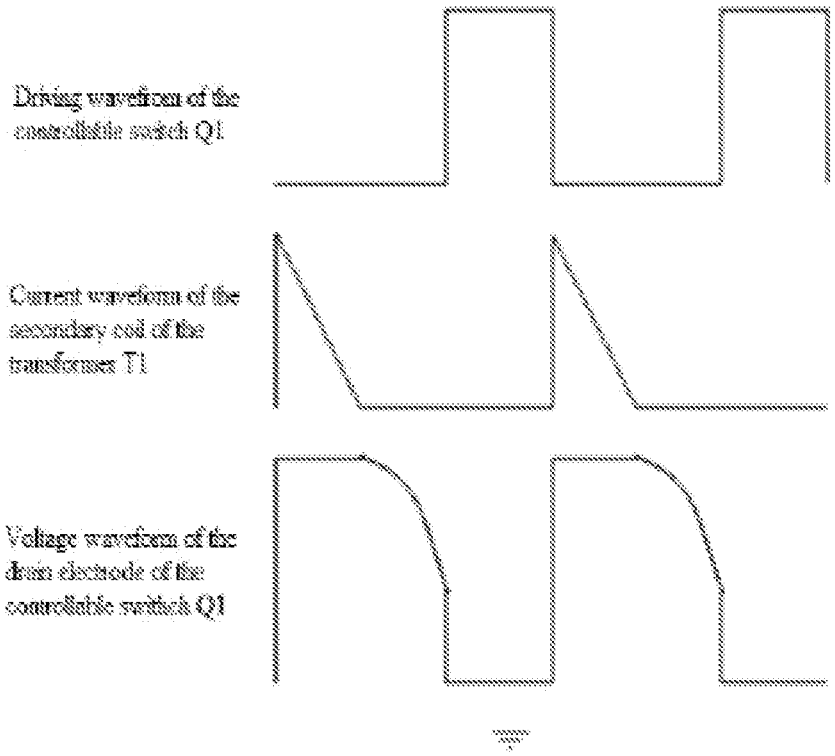
FIG. 3B is a waveform diagram of a backlight driving circuit of a first example of the preset disclosure.

As shown in FIG. 3A and FIG. 3B, a backlight driving circuit of a first example comprises a transformer T1, a controllable switch Q1 connected in series with a primary side 11 of the transformer T1, a voltage collection unit receiving a voltage of the primary side 11 of the transformer T1, and a comparing unit coupled to the voltage collection unit. A secondary side 12 of the transformer T1 is coupled to a light emitting diode (LED) light bar 50.

When an output voltage of the voltage collection unit is less than the preset reference voltage, the comparing unit drives the controllable switch Q1 to turn on.

The voltage collection unit comprises a detection winding T2 couples to the primary side 11 of the transformer T1, and a first resistor R1 connected with the detection winding T2 in parallel, where number of turns of the detection winding T2 is less than the number of turns of the primary side 11 of the transformer T1. The The comparing unit comprises a comparator OP1, a second resistor R2, and a filter capacitor $C_0$. A non-inverting end of the comparator OP1 receives the preset reference voltage $V_0$, an inverting end of the comparator is coupled to a first end of the detection winding T2 through the second resistor R2, where current of the detection winding T2 flows out from the first end of the detection winding T2. The filter capacitor $C_0$ is connected between the inverting end of the comparator OP1 and a ground terminal of the backlight driving circuit.

The backlight driving circuit further comprises an electrolytic capacitor C2, and a rectifier diode D1 connected in series between the secondary side 12 of the transformer T1 and the LED light bar 50. A cathode of the rectifier diode D1 is coupled to an input end of the LED light bar 50, and an anode of the rectifier diode D1 is coupled to the secondary side 12 of the transformer T1. The electrolytic capacitor C2 and the LED light bar 50 are connected in parallel. The rectifier diode D1 can control a flow direction of the current, which avoids the current from flowing to the secondary side 12 of the transformer T1. When an output current of the secondary side 12 of the transformer T1 is not sufficient for the LED light bar to light, the electrolytic capacitor C2 may release stored energy to maintain the LED light bar to light.

In the first example, an electromagnetic coupling method is used to receive voltage of the primary side 11 of the transformer T1 without needing to connect to an additional load of a circuit of the primary side 11 of the transformer T1, and a voltage collection circuit and a main circuit can be isolated. Namely the main circuit is not affected when the voltage collection circuit is damaged, which improves reliability of the main circuit. Additionally, the first example uses the detection winding T2 to proportionally reduce a large voltage of the primary side 11 of the transformer T1, and obtains a low voltage through dividing the voltage by the first resistor R1, the low voltage is safer than the large voltage, withstand voltage requirement of the components to the low voltage is low, which reduces costs of the voltage collection circuit and the comparing circuit. It should be understood, a delay time exists between a lowest voltage of the primary side 11 of the transformer T1 and a lowest value of an oscillation waveform of the drain electrode of the controllable switch Q1. Thus, in order to reduce the oscillation and the EMIT as much as possible when a power loss of the controllable switch Q1 reduces, a resister-capacitor (RC) filter circuit is connected between the inverting end of the comparator OP1 and the voltage collection unit, the delay time may be adjusted by adjusting the second resistor R2 and the filter capacitor $C_0$. When amplitude of a first resonance oscillation of the drain electrode of the controllable switch Q1 reaches a lowest value, a zero voltage signal detected by a third winding circuit is sent to the inverting end of the comparator, and the comparator OP1 outputs a high level (logic 1) to control the controllable switch Q1 to turn on again, and the voltage between the source electrode and the drain electrode of the controllable switch Q1 is low in the moment that the controllable switch Q1 turns on. Thus, the loss is reduced, the voltage of the drain electrode is reduced to zero quickly and does not oscillate, thereby reducing EMI.

EXAMPLE 2

Figure 4:
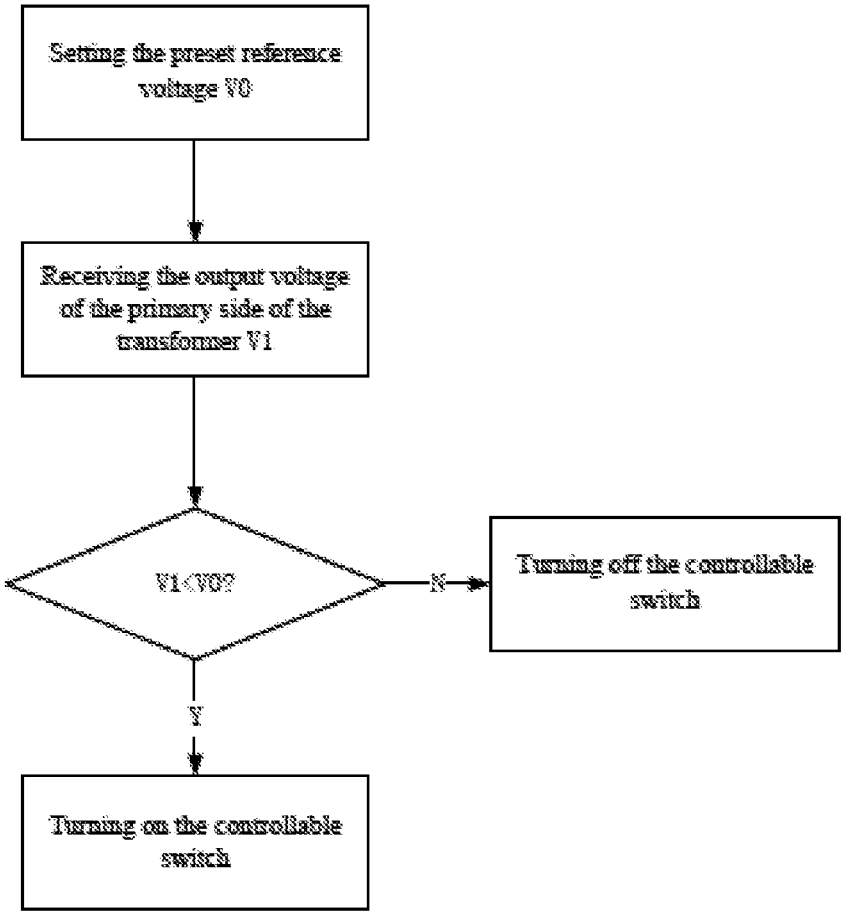
FIG. 4 is a flowchart of a method for driving a backlight driving circuit of a second example of the present disclosure.

As shown in FIG. 4, a second example provides a method for driving the backlight driving of the present disclosure comprising:

A: setting the preset reference voltage V1;

B: receiving the output voltage V1 of the primary side 11 of the transformer T1; and C: comparing the output voltage of the primary side of the transformer with the preset reference voltage; when the output voltage is less than the preset reference voltage, the controllable switch Q1 turns on; when the output voltage is not less than the preset reference voltage, the controllable switch turns off.

The present disclosure is described in detail in accordance with the above contents with the specific exemplary examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

We claim:

1. A liquid crystal display (LCD) device, comprising:

a backlight driving circuit;

wherein the backlight driving circuit comprises a transformer, a controllable switch connected in series with a primary side of the transformer, a voltage collection unit receiving a voltage of the primary side of the transformer, and a comparing unit coupled to the voltage collection unit;

when an output voltage of the voltage collection unit is less than a preset reference voltage, the comparing unit drives the controllable switch to turn on, wherein the voltage collection unit comprises a detection winding coupled to the primary side of the transformer, and a first resistor connected with the detection winding in parallel, number of turns of the detection winding is less than number of turns of the primary side of the transformer, the comparing unit is coupled to an end of the first resistor adjacent to the detection winding, the backlight driving circuit further comprises a light emitting diode (LED) light bar coupled to two ends of a secondary side of the transformer, and a rectifier diode connected in series between the secondary side of the transformer and the LED light bar, and an electrolytic capacitor connected with the LED light bar in parallel; a cathode of the rectifier diode is coupled to an input end of the LED light bar, and an anode of the rectifier diode is coupled to the secondary side of the transformer, wherein the comparing unit comprises a comparator, a non-inverting end of the comparator receives the preset reference voltage, and an inverting end of the comparator is coupled to the voltage collection unit;

when the output voltage of the voltage collection unit is less than the preset reference voltage, the comparing unit drives the controllable switch to turn on, wherein the comparing unit comprises a second resistor and a filter capacitor; the inverting end of the comparator is coupled to the voltage collection unit through the second resistor, the filter capacitor is connected between the inverting end of the comparator and a ground terminal of the backlight driving circuit.

2. A backlight driving circuit, comprising:

a transformer;

a controllable switch connected with a primary side of the transformer in series:

a voltage collection unit receiving a voltage of the primary side of the transformer; and a comparing unit coupled to the voltage collection unit;

when an output voltage of the voltage collection unit is less than a preset reference voltage, the comparing unit drives the controllable switch o turn wherein the comparing unit comprises a comparator, a non-inverting end of the comparator receives the preset reference voltage, and an inverting end of the comparator is coupled to the voltage collection unit;

when the output voltage of the voltage collection unit is less than the preset reference voltage the comparing unit drives the controllable switch to turn on, wherein the comparing unit comprises a second resistor and a filter capacitor, the inverting end of the comparator is coupled to the voltage collection unit through the second resistor; the filter capacitor is connected between the inverting end of the comparator and a ground terminal of the backlight driving circuit.

3. The backlight driving circuit of claim 1, further comprising a light emitting diode (LED) light bar coupled to two ends of a secondary side of the transformer, a rectifier diode connected in series between the secondary side of the transformer and the LED light bar, and an electrolytic capacitor connected with the LED light bar in parallel; a cathode of the rectifier diode is coupled to an input end of the LED light bar, and an anode of the rectifier diode is coupled to the secondary side of the transformer.

* * * * *